US009022119B2

(12) United States Patent
Sims

(10) Patent No.: US 9,022,119 B2
(45) Date of Patent: May 5, 2015

(54) STEAM DISTRIBUTION APPARATUS AND METHOD FOR ENHANCED OIL RECOVERY OF VISCOUS OIL

(71) Applicant: Jackie C. Sims, Houston, TX (US)

(72) Inventor: Jackie C. Sims, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 58 days.

(21) Appl. No.: 14/053,366

(22) Filed: Oct. 14, 2013

(65) Prior Publication Data

US 2014/0041852 A1 Feb. 13, 2014

Related U.S. Application Data

(62) Division of application No. 12/908,687, filed on Oct. 20, 2010, now abandoned.

(60) Provisional application No. 61/254,137, filed on Oct. 22, 2009, provisional application No. 61/254,146, filed on Oct. 22, 2009.

(51) Int. Cl.
*E21B 43/24* (2006.01)

(52) U.S. Cl.
CPC ..... *E21B 43/24* (2013.01); *E21B 43/2406* (2013.01)

(58) Field of Classification Search
USPC ..... 166/334.4, 269, 272.3, 305.1, 303
See application file for complete search history.

(56) References Cited

U.S. PATENT DOCUMENTS

| | | | | |
|---|---|---|---|---|
| 4,046,199 | A | 9/1977 | Tafoya | |
| 4,800,921 | A | 1/1989 | Greebe | |
| 5,141,054 | A | 8/1992 | Alameddine et al. | |
| 5,826,655 | A * | 10/1998 | Snow et al. | 166/272.3 |
| 6,056,050 | A | 5/2000 | Snow et al. | |
| 6,158,510 | A | 12/2000 | Bacon et al. | |
| 6,371,210 | B1 | 4/2002 | Bode et al. | |
| 6,708,763 | B2 | 3/2004 | Howard et al. | |
| 7,350,577 | B2 | 4/2008 | Howard et al. | |
| 7,793,716 | B2 | 9/2010 | Macias et al. | |
| 8,066,071 | B2 | 11/2011 | Sharma et al. | |
| 2008/0251255 | A1 | 10/2008 | Forbes et al. | |
| 2010/0038087 | A1 | 2/2010 | Skillingstad et al. | |

OTHER PUBLICATIONS

Boone, T.J., Touck, D.G., Sun, S.; Targeted Steam Injection Using Horizontal Wells with Limited Entry Perforations, SPE International Conference on Horizontal Wells Technology, Nov. 1-4, 1998, Calgary, Alberta, SPE 50429.

(Continued)

*Primary Examiner* — David Bagnell
*Assistant Examiner* — Ronald Runyan

(57) ABSTRACT

Methods and apparatus for enhanced and improved viscous oil recovery are disclosed. A horizontal well is drilled through the viscous oil formation. A specially designed tubing string includes outlets that deliver steam more uniformly into the entire horizontal extent of the well borehole. Heat from the steam mobilizes and lowers the viscosity of the heavy crude wherein the crude is then produced to the surface via conventional lift arrangements.

14 Claims, 11 Drawing Sheets

(56) References Cited

OTHER PUBLICATIONS

Chien, S.F.; Phase Splitting of Wet Steam in Annular Flow Through a Horizontal Branching Tee, SPE Production and Facilities, p. 83-88, May 1996, SPE 28542-PA.

Chiou, R.C.S., Owens, J.D.; Field Performance of Steam Injection Profile Control Using Limited-Entry Performations, SPE Western Regional Meeting, Mar. 10-Apr. 1, 1992, Bakersfield, California, SPE 24081.

Hwang, S.T., Soliman, H.M., Lahey Jr., R.T.; Phase Separation in Impacting Wyes and Tees, International Journal of Multiphase Flow, vol. 15, Issue 6, p. 965-975, 1989, Mar. 1989.

Seeger. W., Reinmann, J., and Muller, U.; Two-Phase Flow in a T-Junction with a Horizontal Inlet, International Journal of Multiphase Flow, vol. 12, Issue 4, p. 575-585, 1986, Oct. 1985.

Taitel Y, Dukler A E.; A Model for Predicting Flow Regime Transition in Horizontal and Near Horizontal Gas-Liquid Flow. AIChE Journal, vol. 22, Issue 1: p. 47-55, Jan. 1976.

PCT Search Report, PCT/US2010/053407, May 24, 2011.

* cited by examiner

STEAM DISTRIBUTION APPARATUS AND METHOD FOR ENHANCED OIL RECOVERY OF VISCOUS OIL

CROSS-REFERENCE TO RELATED APPLICATIONS

The present application for patent is a division of co-pending U.S. Non-Provisional application bearing Ser. No. 12/908,687, filed on Oct. 20, 2010, which claims the benefit of U.S. Provisional applications bearing Ser. Nos. 61/254,137 and 61/254,146, both filed on Oct. 22, 2009, which are incorporated by reference in their entirety.

BACKGROUND

1. Field of the Invention

This invention relates to oil field production apparatus and techniques, and more particularly, to such apparatus and techniques for use in the production of heavy oil or viscous crude oil.

2. Background of the Invention

It has been known to produce viscous crude oils in reservoirs by drilling vertical wells into the producing zone and then injecting steam into the producing zone to increase the mobility and reduce the viscosity of the viscous crude. This steam injection has been done in several different ways. In one technique, wells in the reservoir can be cyclically steamed using a process called cyclic steam stimulation (CSS). In this process, steam is injected down a vertical well into the producing zone. The steam is allowed to "soak" in the reservoir for a relatively short period of time to heat the crude oils, thus reducing its viscosity and increasing its mobility. The well is then placed back in production for a relatively longer period of time to extract the heated less viscous crude oil. This cycle is typically repeated until the production becomes unprofitable.

Another technique which has been used to produce viscous crude reservoirs is to drill vertical wells in a geometrical pattern into the producing zone, such as in a 5-spot or 9-spot pattern. In these geometrical patterns, the wells are placed within the reservoir field, typically in a symmetric fashion, and are designated as either an injection well or a production well based on its position in the pattern. Steam is continuously injected into the producing zone via the injection wells to heat the viscous crude oil and drive it to neighboring vertical producing wells in the geometrical array.

In the initial development of a reservoir of viscous crude these described methods have worked well. Over time however, the steam tends to congregate in the upper portion of the producing zone. This, of course, may cause less heating of the viscous crude in the lower portion of the producing zone. The heavy crude saturated lower portion of the producing zone is not depleted as the high viscosity of the crude prevents its migration to the well bores of the producing wells. Thus large quantities of potentially producible crude oil can otherwise become not recoverable.

It is known in the art that horizontally-oriented, or horizontal wells can be utilized to help production from the portions of the producing zone, especially the lower portion discussed above, which are typically not depleted after injecting steam with vertical wells. It is desirous in these assemblies to deliver uniformly distributed steam to the producing zone along the entire length of the horizontal section of the well.

Horizontal steam injection wells are becoming more functional and efficient for heavy oil steam flooding and in many cases the only economic solution to produce some reservoirs.

Successful application of horizontal steam injection requires controlled steam distribution along the entire length of the horizontal section. Many devices have been promoted as completion methods to provide this controlled distribution; however, these devices have not been tested and have severe limitations.

The main limitation is that the proposed equipment can at best provide control for the injection of single phase steam ("100% quality"). The performance of such devices when extracting a portion of a wet steam flow, vapor and liquid, suffers from phase splitting effects. This phase splitting phenomenon relates to the fact that the percent of vapor extracted from the total vapor is different than the percent liquid extracted from the total liquid. For example, if the main flow has a steam quality of seventy-percent (70%), the extracted flow may have a significantly higher or lower quality.

Many steam flood operations use two-phase steam consisting of both a vapor and a liquid phase. Even for operations injecting single phase, 100% quality steam at the wellhead, heat losses and water holdup can yield varying steam qualities along the subsurface horizontal section. Furthermore, if both phases do not split proportionally within a device, mass distribution is non-uniform and uniform latent heat—a more crucial reservoir performance criteria—is not achieved.

Most proposed devices extract steam off the main tubing flow through a series of orifices which may or may not feed additional flow restricting mechanisms before delivery to the reservoir. The basis for many of these devices and hopes for success rely on modified Inflow Control Devices ("ICDs") operating in a reversed flow direction ("injection mode"). Although not fully tested, such mechanisms do have potential for the distribution of single phase, 100% quality steam. However, in applications utilizing two-phase steam, flow regime effects and different phase velocities cause unknown phase distributions depending on the vapor-water separation within the device. Optimum steam distribution and latent heat delivery requires a device capable of reliably controlling injected steam over a range of qualities of about forty percent (40%) to one-hundred percent (100%).

SUMMARY

According to an aspect of the present invention, a well assembly is disclosed for injecting steam into a subterranean reservoir. The well assembly includes a string of tubing in fluid communication with a producing zone of a subterranean reservoir. The string of tubing has a substantially vertical section and a substantially horizontal section extending from a lower portion thereof. The substantially horizontal section defines a heel portion at one end and a toe portion at the opposite end. An opening formed on the inner surface of the substantially horizontal section defines an inlet. An opening formed on the outer surface of the substantially horizontal section defines an outlet. A passageway extends between the inlet and the outlet such that steam received by the inlet is delivered to the outlet. The inlet is formed in the string of tubing axially closer to the heel portion than the outlet so that when steam is received by the passageway an axial momentum of the steam is maintained. For example, the passageway can extend less than about fifteen degrees from the inner surface.

In one or more embodiments, the string of tubing has a reduced cross-sectional flow area and the inlet is formed in the reduced cross-sectional flow area. For example, the reduced cross-sectional flow area can have an inwardly tapered surface and the inlet can be formed at least partially on the inwardly tapered surface.

In one or more embodiments, the string of tubing has a reduced cross-sectional flow area having an inwardly tapered surface, an outwardly tapered surface, and a reduced diameter surface extending between the inwardly tapered surface and the outwardly tapered surface so that a velocity of the steam is increased by the inwardly tapered surface and the velocity of the steam is reduced by the outwardly tapered surface.

In one or more embodiments, an annulus that is in fluid communication with the outlet is formed in the outer surface of the string of tubing and extends around the circumference thereof. A nozzle can be positioned within the annulus to control the flow of steam received from the outlet.

Another aspect of the present invention includes a well assembly for injecting steam into a subterranean reservoir. The well assembly includes a string of tubing in fluid communication with a producing zone of a subterranean reservoir. The string of tubing has a substantially vertical section and a substantially horizontal section extending from a lower portion thereof. The substantially horizontal section defines a heel portion at one end and a toe portion at the opposite end. A reduced cross-sectional flow area is positioned between the heel portion and the toe portion of the substantially horizontal section. An opening formed on the inner surface of the reduced cross-sectional flow area defines an inlet. An opening formed on the outer surface of the substantially horizontal section defines an outlet. A passageway extends between the inlet and the outlet to deliver steam from the inlet to the outlet.

In one or more embodiments, the string of tubing has a reduced cross-sectional flow area having an inwardly tapered surface, an outwardly tapered surface, and a reduced diameter surface extending between the inwardly tapered surface and the outwardly tapered surface so that a velocity of the steam is increased by the inwardly tapered surface and the velocity of the steam is reduced by the outwardly tapered surface.

In one or more embodiments, the inlet is formed on the reduced diameter surface. For example, the inlet can be axially closer to the heel portion than the outlet so that when steam is received by the passageway an axial momentum of the steam is maintained. Alternatively, the inlet and the outlet can be formed at substantially the same axial locations between the heel portion and the toe portion.

In one or more embodiments, the inlet is formed at least partially on the inwardly tapered surface. For example, the inwardly tapered surface can be tapered about fifteen degrees from an axis of the substantially horizontal section and the inlet can be about parallel to the axis of the substantially horizontal section.

In one or more embodiments, an annulus that is in fluid communication with the outlet is formed in the outer surface of the string of tubing and extends around the circumference thereof. A nozzle can be positioned within the annulus to control the flow of steam received from the outlet.

Another aspect of the present invention includes a well assembly for injecting steam into a subterranean reservoir. The well assembly includes a string of tubing in fluid communication with a producing zone of a subterranean reservoir. The string of tubing has a substantially vertical section and a substantially horizontal section extending from a lower portion thereof. The substantially horizontal section defines a heel portion at one end and a toe portion at the opposite end. A reduced cross-sectional flow area having an inwardly tapered surface, an outwardly tapered surface, and a reduced diameter surface extending between the inwardly tapered surface and the outwardly tapered surface is positioned between the heel portion and the toe portion of the substantially horizontal section. An opening formed on the inner surface of the reduced cross-sectional flow area defines an inlet. An opening formed on the outer surface of the substantially horizontal section defines an outlet. A passageway extends between the inlet and the outlet such that steam received by the inlet is delivered to the outlet. The inlet is formed in the string of tubing axially closer to the heel portion than the outlet so that when steam is received by the passageway an axial momentum of the steam is maintained.

In one or more embodiments, the inlet is formed on the reduced diameter surface. For example, the passageway can extend less than about fifteen degrees from the inner surface of the reduced diameter surface.

In one or more embodiments, the inlet is formed at least partially on the inwardly tapered surface. For example, the inwardly tapered surface can be tapered about fifteen degrees from an axis of the substantially horizontal section and the inlet can be about parallel to the axis of the substantially horizontal section.

In one or more embodiments, an annulus that is in fluid communication with the outlet is formed in the outer surface of the string of tubing and extends around the circumference thereof. A nozzle can be positioned within the annulus to control the flow of steam received from the outlet.

DETAILED DESCRIPTION

Figure 1:
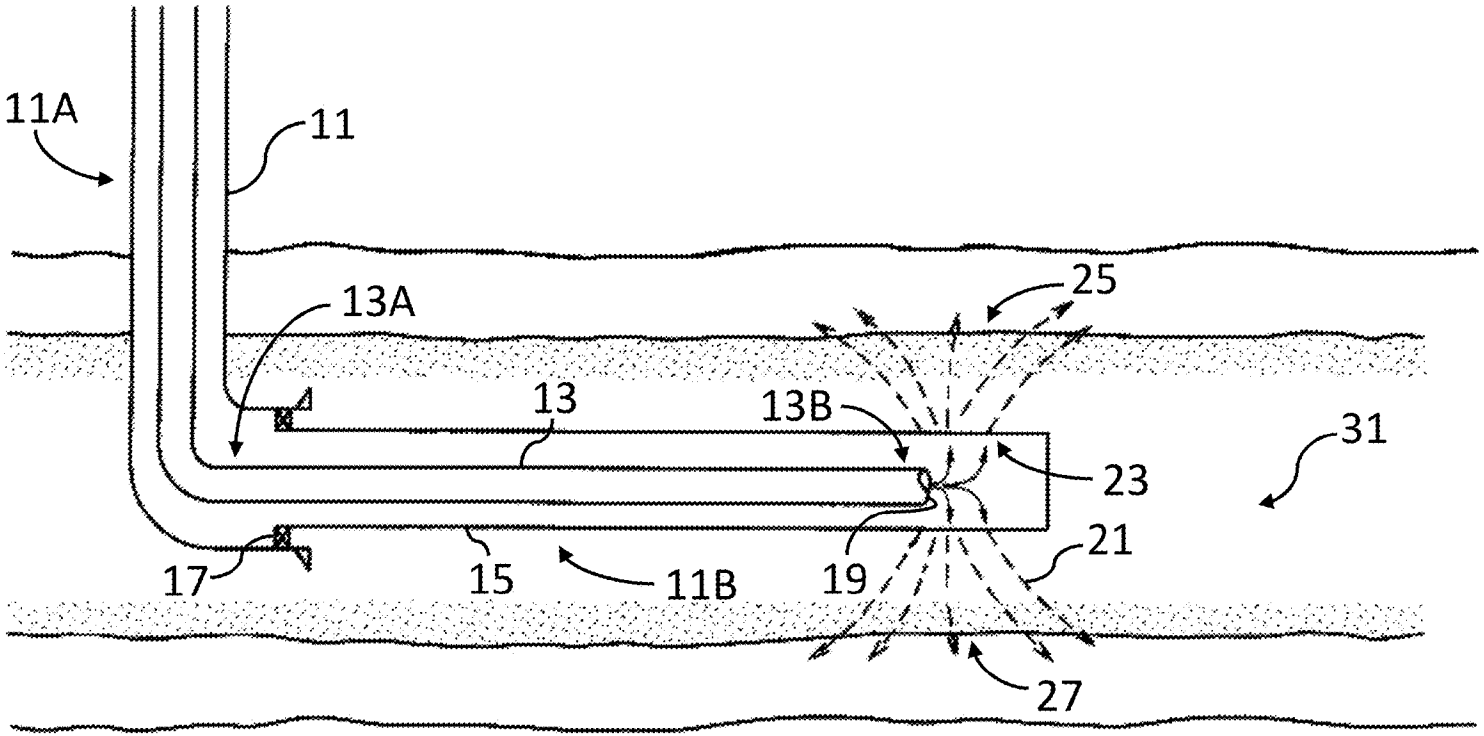
(PRIOR ART) FIG. 1
FIG. 1 is a schematic, sectional view of a prior art steam delivery in a horizontal well in the field of hydrocarbon production.

Referring initially to prior art FIG. 1, a cross sectional view shows a wellbore 11 having vertical section 11A and horizontal section 11B. Wellbore 11 provides a flow path between the well surface and producing sand or reservoir 31. Tubing string 13 and slotted liner 15 are also shown in FIG. 1. The horizontal section 11B of tubing string 13 includes a heel portion 13A and an opposite toe portion 13B. Slotted liner 15 is a completion device lining horizontal section 11B of wellbore 11 and is typically isolated by a lead seal 17 from vertical section 11A of wellbore 11. Live steam is supplied via tubing string 13 and exits from toe portion 13B at end 19. The steam flow is as indicated by arrows 21. Direct impingement of live steam onto slotted liner 15 at the area numbered 23 can potentially cause erosion and collapse of the liner 15, which is an undesirable condition. Also, using this technique the steams' heat is concentrated near toe portion 13B in areas 25 and 27 of reservoir 31 rather than along the length of slotted liner 15.

Figure 2:
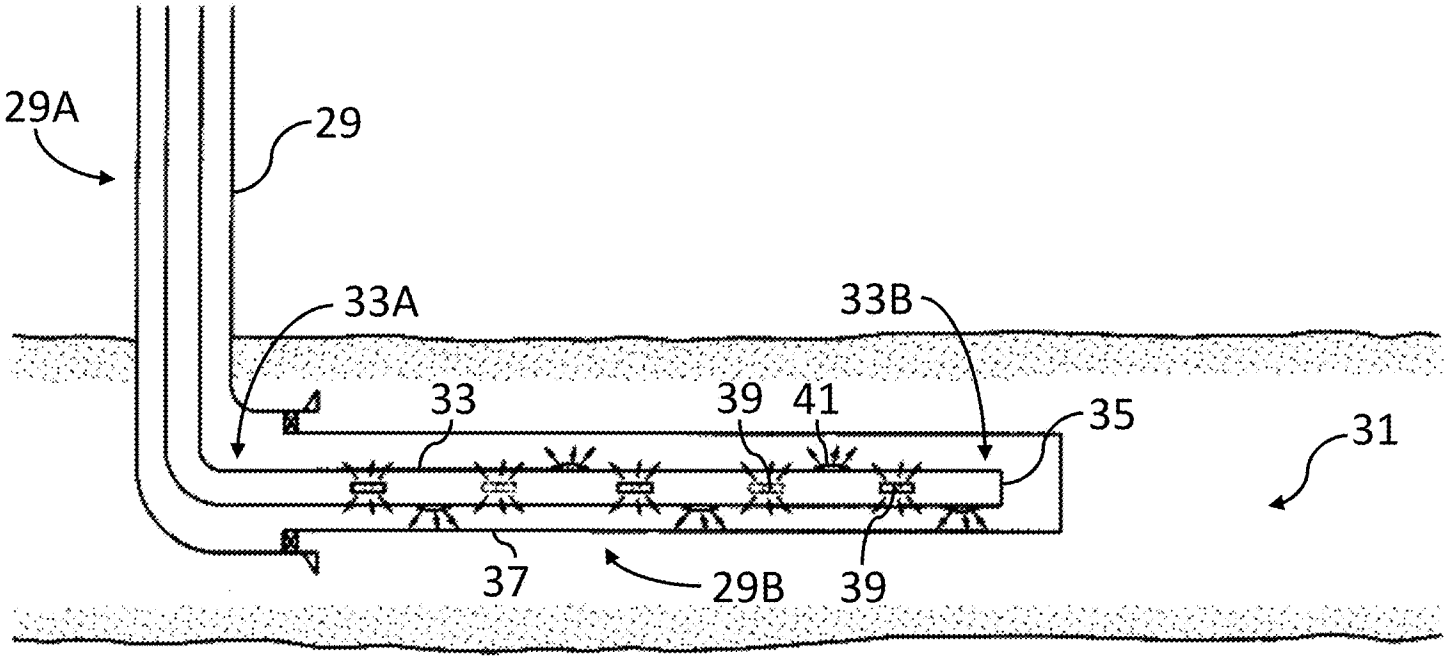
(PRIOR ART) FIG. 2
FIG. 2 is a schematic, sectional view of a prior art steam delivery in a horizontal well in the field of hydrocarbon production.

Referring now to prior art FIG. 2, wellbore 29 has vertical section 29A, which goes to the surface, and horizontal section 29B that penetrates a long horizontal section of producing sand or reservoir 31. Slotted liner 37 lines horizontal section 29B of wellbore 29. Tubing string 33 is run in from the surface and, on the lower end thereof is plugged off by plug 35. The horizontal section 29B of tubing string 33 includes a heel portion 33A and an opposite toe portion 33B. The length of tubing string 33, prior to the plug 35, is provided with spaced apart drilled holes 39 along its entire horizontal section between heel portion 33A and toe portion 33B. Each drilled hole 39 is covered with a sacrificial impingement strap 41. Sacrificial impingement straps 41 are constructed of a carbon steel material and may be ceramic coated if desired. Sacrificial impingement straps 41 are welded to tubing string 33 with an offset above each drilled hole 39.

A steam generator source (not shown) is located at the surface and provides an input of steam into tubing string 33. The steam travels down tubing string 33 to its lower horizontal section 29B where it exits via drilled holes 39. As will be described, while steam can exit tubing string 33 between heel portion 33A and toe portion 33B, uniform mass distribution and latent heat is not achieved along horizontal section 29B.

Figure 3:
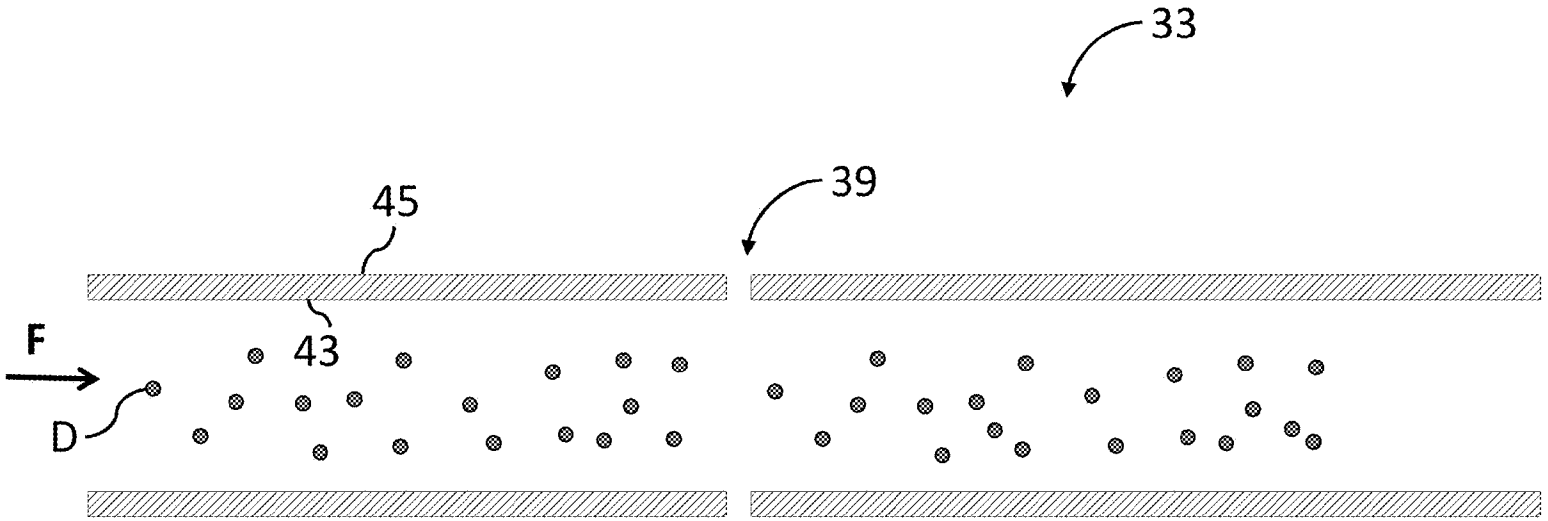
(PRIOR ART) FIG. 3
FIG. 3 is a schematic, sectional view of a prior art tubing string distribution assembly for use in a horizontal well in the field of hydrocarbon production.

Referring to FIG. 3, a cross-section of a portion of tubing string 33 that is located within slotted liner 37 of FIG. 2 is shown. Sacrificial impingement straps 41 are not shown in FIG. 3. Tubing string 33 includes inner surface 43 and outer surface 45. A plurality of drilled holes 39 extend from inner surface 43 to outer surface 45. Each drilled hole 39 extends radially outward, substantially perpendicular to inner surface 43. Typically, drilled holes 39 are intermittently spaced between heel portion 33A and toe portion 33B of tubing string 33 for delivering steam to reservoir 31. A two-phase fluid F, typically steam having vaporous water and liquid water droplets D, travel through tubing string 33 for delivery into oil sands or reservoir 31.

When two-phase fluid F is under low velocity conditions, such as less than 40 feet per second, the flow is stratified. In particular, gravity causes the liquid phase to travel along the bottom portion of the pipe. When superficial vapor and liquid velocities are both low, the interface between the liquid and vapor phases is smooth. As vapor velocities begin to increase, the interface becomes wavy. As the superficial liquid velocities increase, the flow tends to form in slugs or large waves of liquid (short in duration) separated by stratified wavy flow. At very high superficial flow velocities, the liquid forms a ring on the inner surface of the pipe wall and the vapor travels in the center of the pipe. At high superficial vapor velocities and steam qualities, the liquid becomes entrained in the vapor core such that the pipe is filled with vapor except for small droplets of liquid mist.

Liquid droplets D have higher densities and thus higher momentum than the vaporous water, which restricts the ability of liquid droplets D to change direction. When liquid droplets D traveling in the main flow of fluid F encounter a smaller vapor flow, or velocity profile, toward drilled holes 39, liquid droplets D experience a drag force to change direction. However, the momentum of liquid droplets D opposes this change of direction, thereby resulting in less movement toward drilled holes 39. In the embodiment shown in FIG. 3, the liquid droplets entrained in the vapor core must make sharp, radially outward turns with respect to the flow of fluid F for liquid droplets to enter drilled holes 39 for delivery into reservoir 31. This results in the extracted steam having less liquid droplets D such that the quality of the steam delivered at the upstream portion of tubing string 33 is different from the steam delivered to the downstream portion of tubing string 33. In particular, more liquid droplets will be delivered toward the downstream toe portion 33A of tubing string 33 than to heel portion 33B. Such a phenomenon is known as "phase splitting."

In FIGS. 4-8, alternative tubing configurations are provided to counteract the phase splitting described above so that more uniform quality steam is delivered to reservoir 31 from both the upstream and downstream portions of the respective tubing strings. More particularly, FIGS. 4-8 each show a portion of tubing sub or string of tubing 111 disposed between the heel portion and the toe portion of the horizontal section of a wellbore. As will be described, steam generated at the surface is delivered to tubing 111 for a more uniform steam quality distribution along the horizontal section of a wellbore into reservoir 31.

Figure 4:
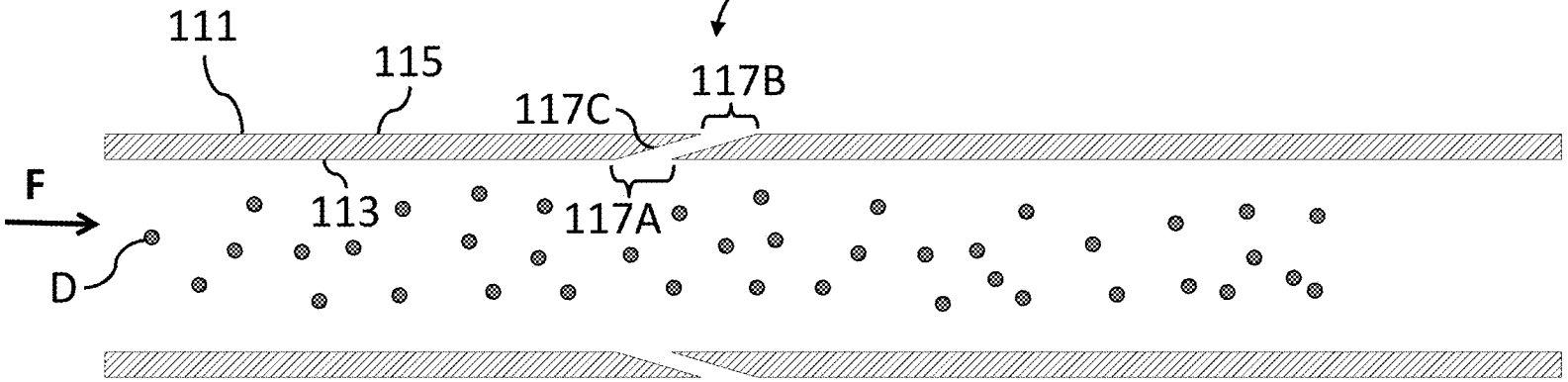
FIG. 4 is a schematic, sectional view of a tubing string distribution assembly according to an embodiment of the present invention for use in a horizontal well in the field of hydrocarbon production.

Referring to FIG. 4, tubing 111 includes a plurality of openings 117 extending from inner surface 113 to outer surface 115. Openings 117 include an opening formed on inner surface 113 that defines inlet 117A, an opening formed on outer surface 115 that defines outlet 117B, and passageway 117C extending between inlet 117A and outlet 117B such that steam received by inlet 117A is delivered to outlet 117B. Inlet 117A is formed in the string of tubing axially closer to the heel portion than outlet 117B. While openings 117 are illustrated as having about fifteen degree outward angles to the flow of fluid F, it should be understood that the optimum angle for openings 117 is the smallest angle allowed by machining tools.

A plurality of openings 117 are preferably intermittently spaced along the length of tubing 111. For example, openings 117 can be positioned every 100 to 500 feet along tubing 111. In general, spacing of openings 117 will be dependent upon the particular reservoir characteristics. One skilled in the art will appreciate that isolation between a first group of openings 117 and a second group of openings 117 can be utilized. Furthermore, conventional sand control mechanisms, such as a sand screen, can be placed adjacent to openings 117. In one embodiment, tubing 111 ends near the heel portion and openings 117 are configured in the liner.

Openings 117 reduce the directional change necessary for liquid droplets to enter openings 117, thereby making it easier for liquid droplets to exit tubing 111. In particular, when steam is received by passageway 117C an axial momentum of the steam is maintained. Accordingly, the difference in steam quality delivered from the upstream portion of tubing 111 compared with the downstream portion of tubing 111 is reduced as more liquid droplets entrained in the vapor core are able to exit openings 117.

Figure 5:
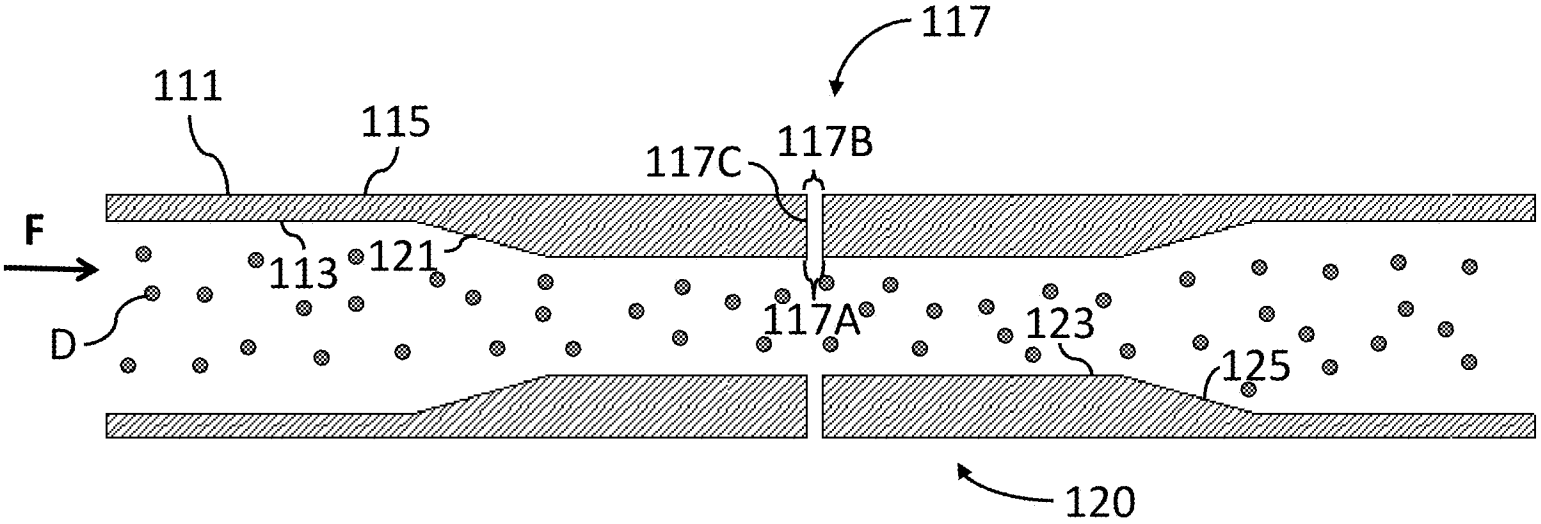
FIG. 5 is a schematic, sectional view of a tubing string distribution assembly according to an embodiment of the present invention for use in a horizontal well in the field of hydrocarbon production.

Referring to FIG. 5, an alternative tubing configuration is provided to counteract the segregation of vapor and liquid in Fluid F so that more uniform quality steam is delivered to reservoir 31 from both the upstream and downstream portions of the respective tubing strings. As shown in FIG. 5, tubing 111 includes mandrel portion or tubing sub 120 with a reduced cross-sectional flow area and a plurality of openings 117 extending from inner surface 113 to outer surface 115. Openings 117 include an opening formed on inner surface 113 that defines inlet 117A, an opening formed on outer surface 115 that defines outlet 117B, and passageway 117C extending between inlet 117A and outlet 117B such that steam received by inlet 117A is delivered to outlet 117B. Inlet 117A and outlet 117B are formed at substantially the same axial locations between the heel and the toe of the string of tubing. As with the embodiment in FIG. 4, a plurality of openings 117 are preferably intermittently spaced along the length of tubing 111, with each opening 117 being associated with a tubing sub 120.

Tubing sub 120 includes inwardly tapered surface 121 that extends between the portion of inner surface 113 having the normal diameter of tubing 111 and reduced diameter surface 123, which is where openings 117 are located. Inwardly tapered surface 121 is located upstream of openings 117 to condition the flow of fluid F. Tubing sub 120 can also include outwardly tapered surface 125 that is positioned downstream of openings 117, and that extends from reduced diameter surface 123 to the portion of inner surface 113 having the normal diameter of tubing 111.

The reduction in the diameter of tubing 111 at inwardly tapered surface 121 increases the velocity of fluid F, while the increase in diameter from outwardly tapered surface 125 reduces the velocity of fluid F. The continued variation of the velocity of fluid F along the length of tubing 111 induces mixing of liquid droplets D with the vaporous water prior to flowing toward openings 117. Mixing fluid F can help provide a more uniform steam quality being delivered along the length of tubing 111. By way of example, if tubing 111 were a conventional string of 4.5 inch tubing, inner diameter 113 would be about 3.96 inches. The desired velocity change could be achieved when reduced diameter surface 123 is equivalent to the inner diameter of standard 2⅜ inch tubing, which is about 2.44 inches. Preferably inwardly and outwardly tapered surfaces 121, 125 are at about fifteen degree respective inclines or declines.

Figure 6:
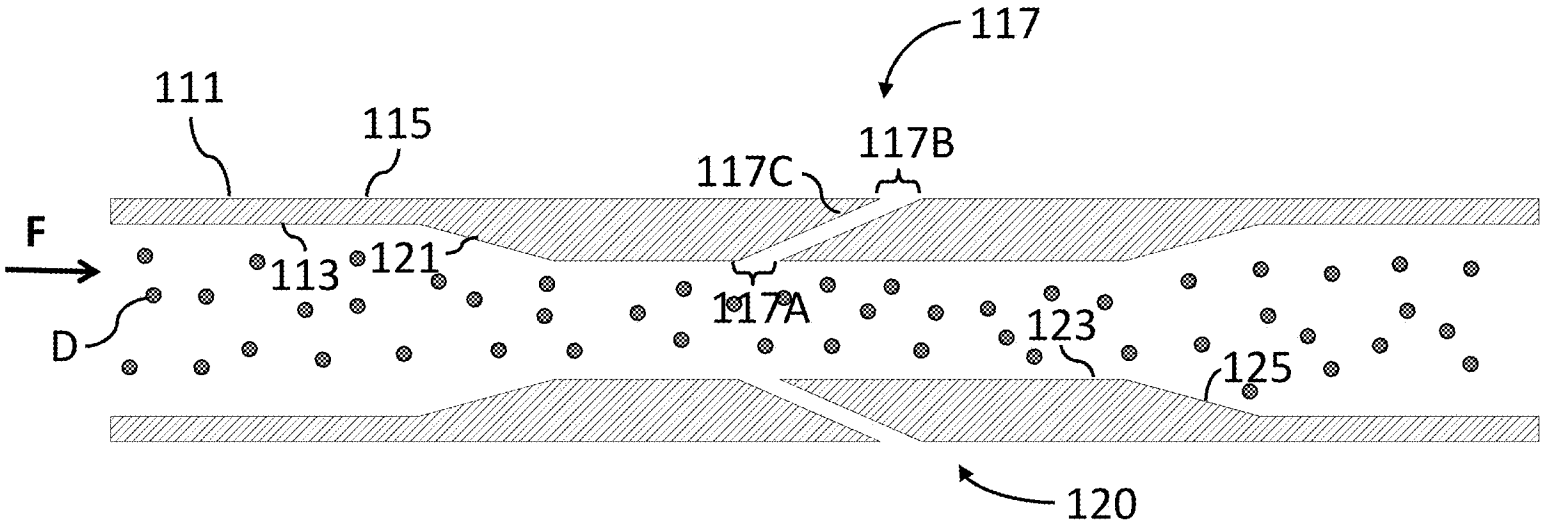
FIG. 6 is a schematic, sectional view of a tubing string distribution assembly according to an embodiment of the present invention for use in a horizontal well in the field of hydrocarbon production.

Referring to FIG. 6, an alternative tubing configuration is shown where tubing 111 includes openings 117 extending at an angle from inner surface 113 to outer surface 115. Openings 117 include an opening formed on inner surface 113 that defines inlet 117A, an opening formed on outer surface 115 that defines outlet 117B, and passageway 117C extending between inlet 117A and outlet 117B such that steam received by inlet 117A is delivered to outlet 117B. Inlet 117A is formed in the string of tubing axially closer to the heel portion than outlet 117B.

In the embodiment, the diameter of inner surface 113 adjacent openings 117 is reduced, thereby making the thickness of tubing 111 immediately upstream and downstream of openings 117 thicker than in the embodiment shown in FIG. 4. Similar to FIG. 5, tubing sub 120 includes inwardly extending tapered surface 121 that extends between the portion of inner surface 113 having the normal diameter of tubing 111 and reduced diameter surface 123, which is where openings 117 are located. Inwardly tapered surface 121 is located upstream of openings 117 to condition the flow of fluid F. Outwardly tapered surface 125 is positioned downstream of openings 117 and extends from reduced diameter surface 123 to the portion of inner surface 113 having the normal diameter of tubing 111.

Figure 7:
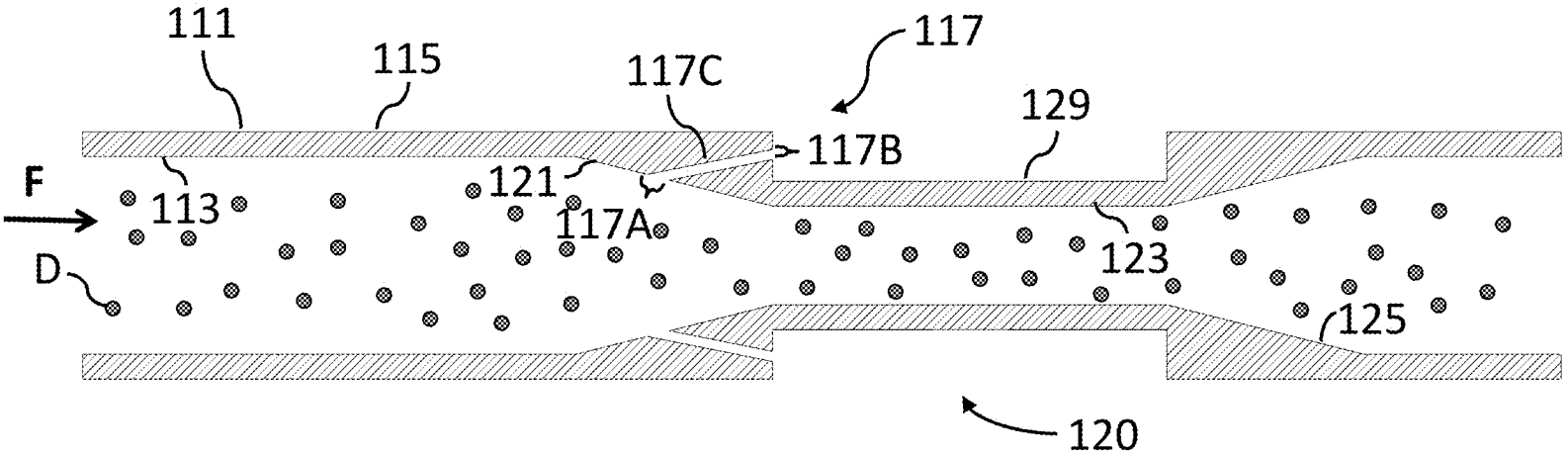
FIG. 7 is a schematic, sectional view of a tubing string distribution assembly according to an embodiment of the present invention for use in a horizontal well in the field of hydrocarbon production.

Tubing sub 120 in FIG. 7 is substantially the same as in FIGS. 5 and 6 except that openings 117 extend axially through tubing 111 from inwardly tapered surface 121. Openings 117 include an opening formed on inner surface 113 that defines inlet 117A, an opening formed on outer surface 115 that defines outlet 117B, and passageway 117C extending between inlet 117A and outlet 117B such that steam received by inlet 117A is delivered to outlet 117B. Inlet 117A is formed in the string of tubing axially closer to the heel portion than outlet 117B. Preferably, openings 117 are as close to parallel with the axial flow of fluid F as possible with machining capabilities. Locating openings 117 on inwardly tapered surface 121 allows liquid droplets to enter outlets 117 with minimal deviation from the path of liquid droplets D prior to encountering reduced diameter surface 123. For example, the inwardly tapered surface 121 can be tapered about fifteen degrees from an axis of the tubing 111 and the inlet can be about parallel to the axis of the tubing 111.

As shown in FIG. 7, openings 117 extend axially to an annulus 129 formed radially outward of reduced diameter surface 123. In particular, annulus 129 is formed in the outer surface 115 of the string of tubing and extends around the circumference thereof. However, in some embodiments annulus 129 is not present and openings 117 axially extend between inwardly tapered surface 121 and outer surface 115.

Figure 8:
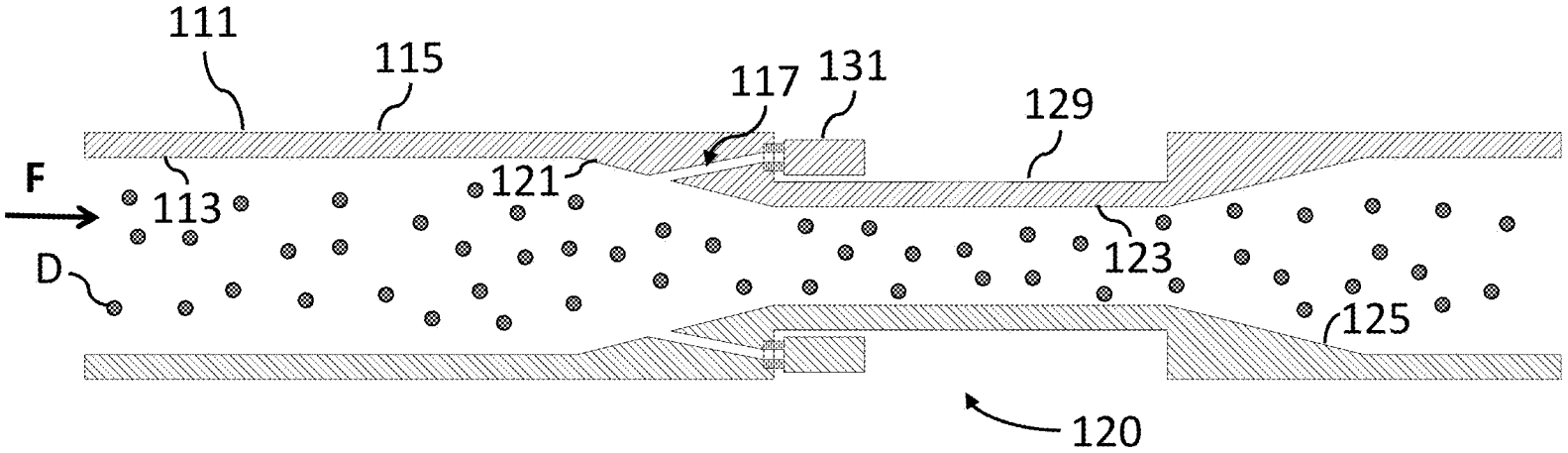
FIG. 8 is a schematic, sectional view of a tubing string distribution assembly according to an embodiment of the present invention for use in a horizontal well in the field of hydrocarbon production.

The embodiment shown in FIG. 8 is substantially the same as FIG. 7 except that nozzles 131 are positioned in annulus 129 to receive fluid from openings 117. Nozzles 131 can be sized to more precisely control the rate of steam delivery into reservoir 31 from each opening 117 along tubing 111. Examples of nozzles 131 include an orifice with a reduced cross-section or a venturi. Additionally, because nozzles 131 are controlling the rate of steam delivery in this embodiment, openings 117 can be enlarged to enhance liquid droplet D capture to a predetermined amount.

The uniform steam delivery described with respect to the above embodiments can prevent steam migration into the underlying water zone or into the upper desaturated portion of the reservoir. Also by delivering the steam uniformly along the entire horizontal section of the producing zone penetrated by the horizontal section of the well, any potential damage to a production liner in this horizontal bore is reduced. Furthermore, the above embodiments reduce phase splitting along the horizontal section of the wellbore, thus delivering a uniform steam quality and ensuring uniform latent heat to the reservoir.

Example I

The performance of alternative tubing configurations can be illustrated through the use of a two-phase flow model. In particular, fluid typically flows as a film along the wall of the pipe and as droplets entrained in the vapor core. The liquid entrainment and film thickness in a flowing pipe can be determined using the two-phase flow model. Liquid entrainment can be estimated by the percent of the total liquid on the circumference of the pipe wall that is traveling at significantly lower velocity. At high superficial vapor velocities the liquid on the circumference of the pipe wall becomes entrained in the vapor core resulting in the pipe being filled with vapor and small liquid droplets D. Since gravitational effects in a horizontal section creates thicker films on the bottom, often the liquid thickness is also expressed in terms of a mean film thickness, which would represent the thickness of the film if evenly distributed over the entire inner circumference. In general, if more of the liquid is entrained in the vapor, a more representative sampling or extraction of two-phase flow will occur.

A two-phase flow model for 4.5 inch diameter tubing with a pressure of 400 psig, a mass flow rate of 1200 barrels of steam per day, and a steam quality of seventy percent (70%) was performed. The calculated liquid entrainment was twenty-six percent (26%), the mean liquid film thickness was 0.037 inches, and the bottom liquid film thickness was 0.14 inches. When the tubing is reduced to 3.5 inches and the other flow conditions are kept the same, the liquid entrainment is ninety-six percent (96%), the mean liquid film thickness is 0.003 inches, and the bottom liquid film thickness is 0.008 inches. The reduced cross-section increased the calculated entrained liquid from twenty-six percent (26%) to ninety-six percent (96%) and greatly reduced the liquid film to yield a more evenly and predictable extraction or distribution.

Example II

As will be described below, the performance of alternative tubing configurations are compared to prior art tubing string distribution assemblies using a surface horizontal steam injection facility. The horizontal steam injection facility is capable of testing a wide range of full-sized downhole completion equipment, such as tubing and liner flow control devices, at the surface under controlled conditions. Additional details of the surface horizontal steam injection facility can be found in S.P.E. paper #132410, titled, "Addressing Horizontal Steam Injection Completions Challenges with Chevron's Horizontal Steam Injection Test Facility."

The steam quality extracted from the various tubing configurations was measured for all possible combinations of three inlet pressures, two inlet steam qualities, six inlet rates and two pressure extraction ratios. The figures below show the difference between the steam quality extracted through the device's exit and the steam quality flowing in the tubing as a function of the tubing superficial vapor velocity.

Figure 9:
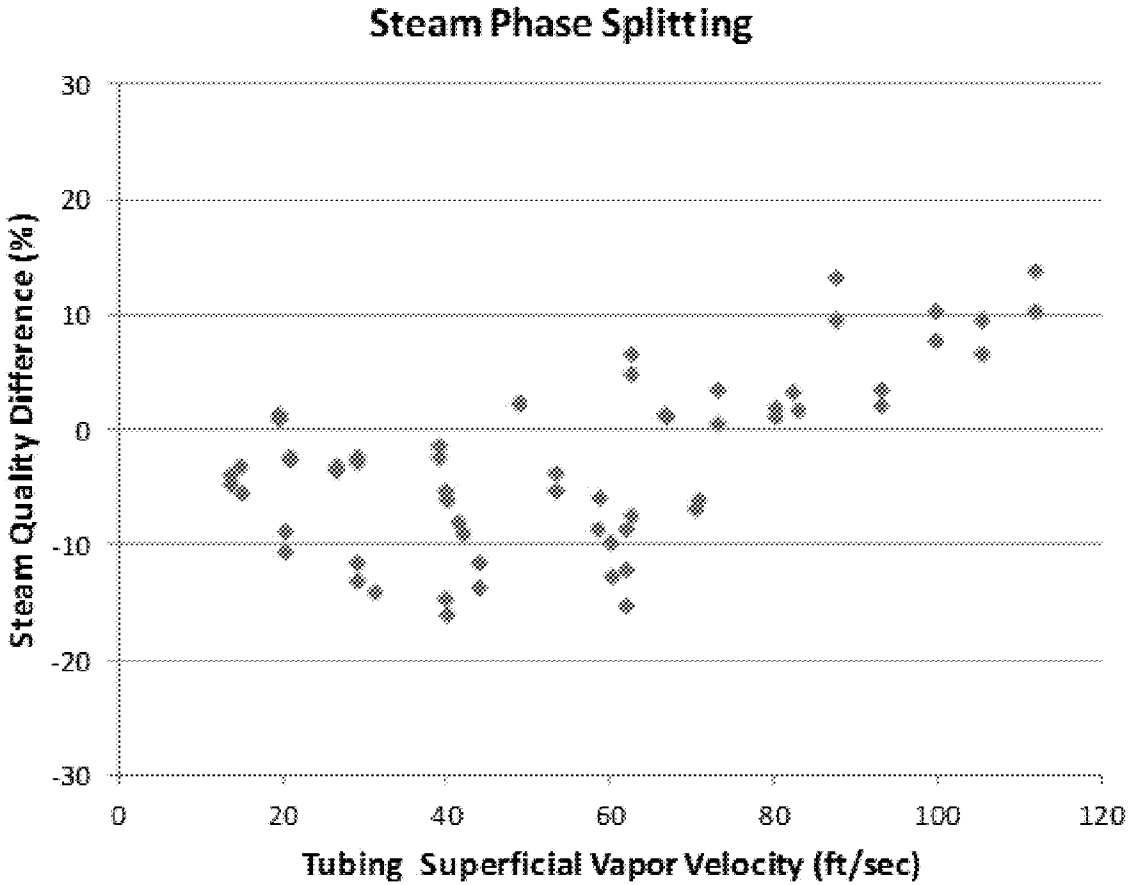
FIG. 9 is a graph of steam phase splitting for a conventional tubing string distribution assembly for use in a horizontal well in the field of hydrocarbon production.

FIG. 9 shows steam quality results obtained using 4.5 inch tubing with four one-quarter inch holes drilled perpendicular from horizontal and phased 90 degrees around the circumference. This tubing device is similar to that shown in FIG. 3, where liquid droplets must make a sharp 90 degree turn with respect to the flow of fluid for the liquid droplets to enter the holes for delivery into the reservoir. The range of steam quality differences between the entrance and extraction of the device has a large variation of −15 to +15 steam quality units.

Figure 10:
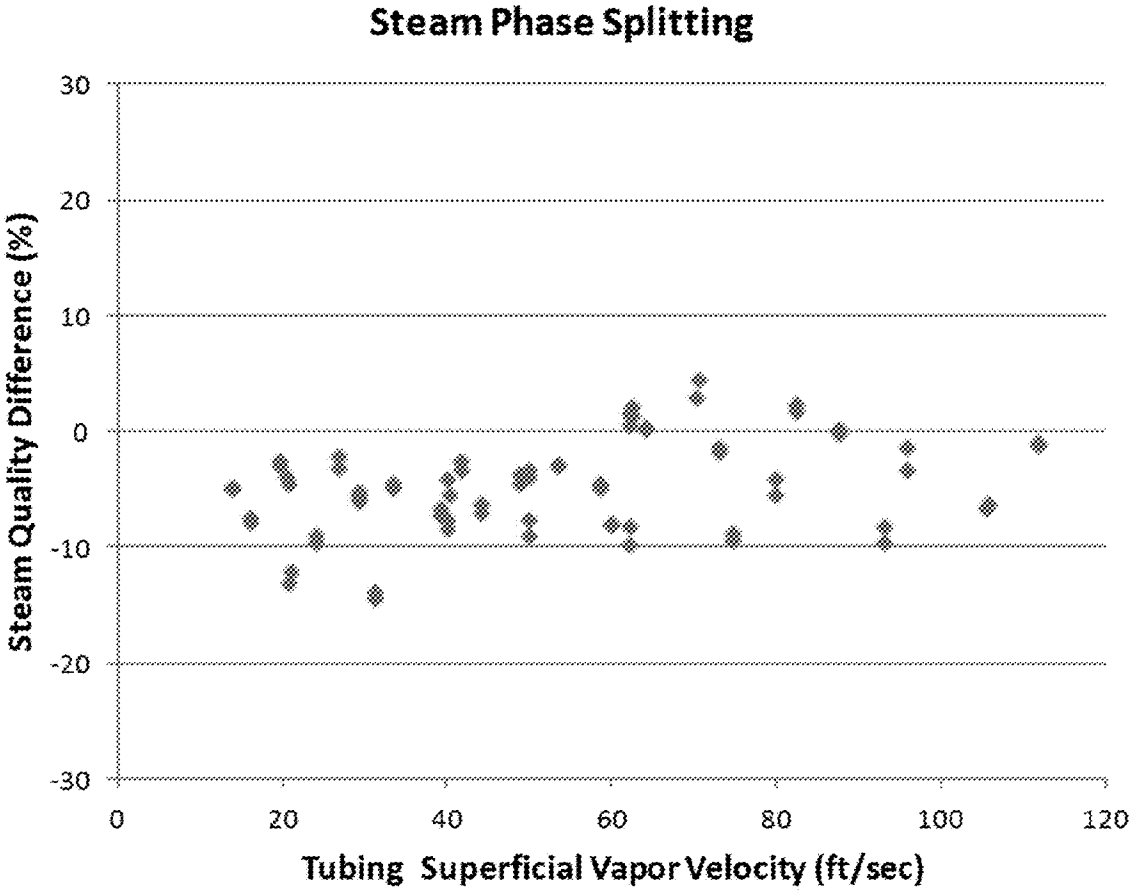
FIG. 10 is a graph of steam phase splitting for a tubing string distribution assembly according to an embodiment of the present invention for use in a horizontal well in the field of hydrocarbon production.

FIG. 10 shows steam quality results obtained using a 4.5 inch tubing with four one-quarter inch holes drilled perpendicular from horizontal and phased 90 degrees around the circumference of a reduced 2" internal diameter. Improvement in the steam quality difference can be observed with the holes positioned proximate to a reduced internal diameter compared to a device without a reduced cross-section (FIG. 9)—particularly at velocities greater than 40 ft/sec where the steam quality difference is maintained within a smaller steam quality difference band (−10 to +5). As previously discussed, the reduced internal diameter varies the velocity of the steam along the length of tubing, thus inducing mixing of liquid droplets with the vaporous water prior to the steam exiting via the drilled holes.

Figure 11:
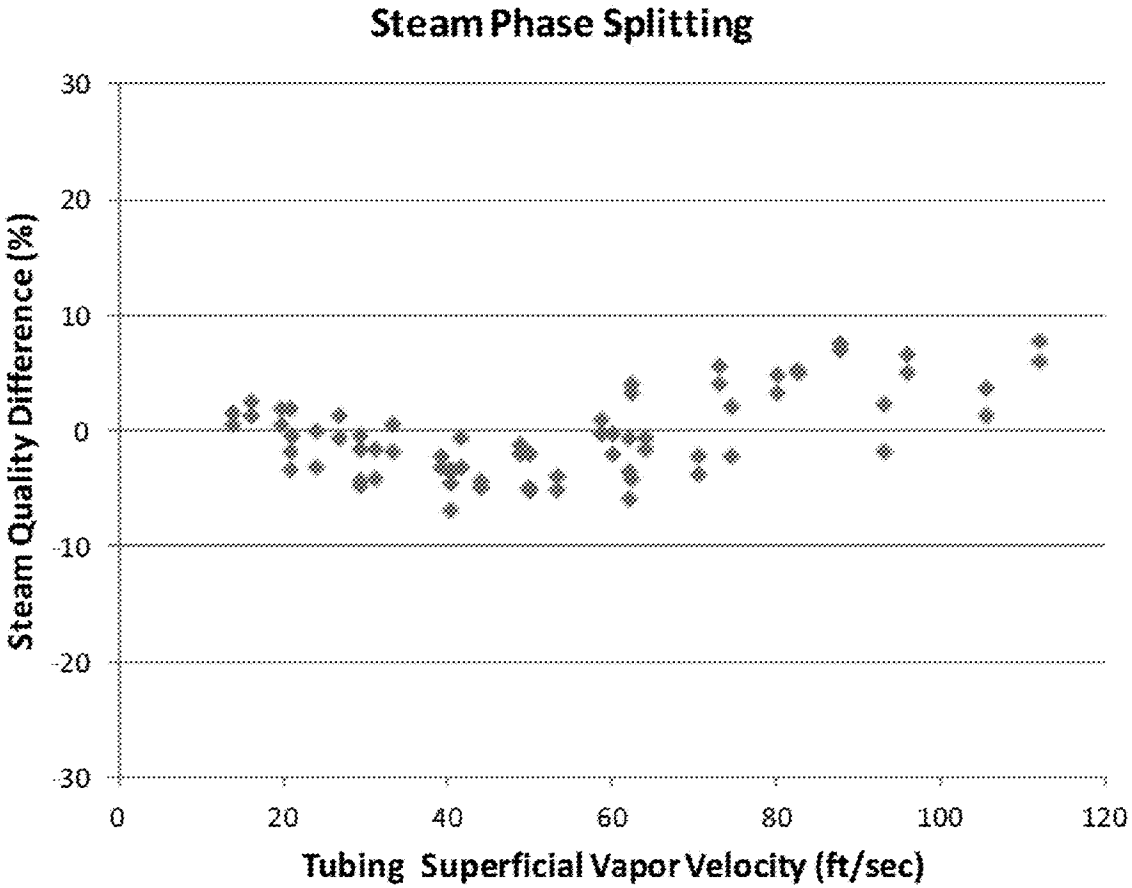
FIG. 11 is a graph of steam phase splitting for a tubing string distribution assembly according to an embodiment of the present invention for use in a horizontal well in the field of hydrocarbon production.

FIG. 11 shows steam quality results obtained using 4.5 inch tubing with four one-quarter inch holes drilled at 15 degree angles from horizontal and phased 90 degrees around the circumference of a reduced 2" internal diameter. The tubing configuration used to produce the results shown in FIG. 11 is substantially the same as the tubing configuration used to produce the results shown in FIG. 10 except that the drilled holes are now angled at 15 degrees from horizontal. The difference between the steam quality extracted through the angled holes and the steam quality flowing through the tubing is minimized for all tubing superficial vapor velocities. In particular, the steam quality over the entire velocity range yields a tighter steam quality difference band compared to the steam quality obtained using the four one-quarter inch holes drilled perpendicular from horizontal without a reduced internal diameter as shown in FIG. 9.

While the invention has been shown in only some of its forms, it should be apparent to those skilled in the art that it is not so limited, but susceptible to various changes without departing from the scope of the invention. For example, tubing 111 for each of the embodiments shown in FIGS. 4-8 could be a tubing sub that is positioned between pairs of tubing rather than being integrated in the string of tubing itself.

What is claimed is:

1. A well assembly for injecting steam into a subterranean reservoir, the well assembly comprising:

a string of tubing in fluid communication with a producing zone of a subterranean reservoir, the string of tubing comprising a substantially vertical section and a substantially horizontal section extending from a lower portion of the substantially vertical section, the substantially horizontal section defining at one end a heel portion and at an opposite end a toe portion;

a reduced cross-sectional flow area positioned between the heel portion and the toe portion of the substantially horizontal section, the reduced cross-sectional flow area comprising an inwardly tapered surface;

an opening formed on the inner surface of the substantially horizontal section that defines an inlet, the inlet is formed at least partially on the inwardly tapered surface;

an opening formed on the outer surface of the substantially horizontal section that defines an outlet;

a passageway extending between the inlet and the outlet such that steam received by the inlet is delivered to the outlet; and the inlet being formed in the string of tubing axially closer to the heel portion than the outlet so that when steam is received by the passageway an axial momentum of the steam is maintained for a steam quality difference between the inlet and the outlet ranging from −15 to +15 stem quality units; and wherein the injected steam is a two-phase steam having a steam quality of less than 100% and over 40%.

2. The well assembly of claim 1, wherein the passageway extends about fifteen degrees from the inner surface.

3. The well assembly of claim 1, wherein the reduced cross-sectional flow area further comprises an outwardly tapered surface and a reduced diameter surface extending between the inwardly tapered surface and the outwardly tapered surface so that a velocity of the steam is increased by the inwardly tapered surface and the velocity of the steam is reduced by the outwardly tapered surface.

4. The well assembly of claim 1, further comprising an annulus formed in the outer surface of the string of tubing that extends around the circumference thereof, the annulus being in fluid communication with the outlet.

5. The well assembly of claim 4, further comprising a nozzle positioned within the annulus to control the flow of steam received from the outlet.

6. A well assembly for injecting steam into a subterranean reservoir, the well assembly comprising:

a string of tubing in fluid communication with a producing zone of a subterranean reservoir, the string of tubing having a substantially vertical section and a substantially horizontal section extending from a lower portion of the substantially vertical section, the substantially horizontal section defining at one end a heel portion and at an opposite end a toe portion;

a reduced cross-sectional flow area positioned between the heel portion and the toe portion on an inner surface of the substantially horizontal section;

an opening formed on an inwardly tapered surface of the reduced cross-sectional flow area that defines an inlet;

an opening formed on an outer surface of the substantially horizontal section that defines an outlet; and a passageway extending between the inlet and the outlet to deliver steam from the inlet to the outlet for a steam quality difference between the inlet and the outlet ranging from −15 to +15 stem quality units; and wherein the injected steam is a two-phase steam having a steam quality of less than 100% and over 40%.

7. The well assembly of claim 6, wherein the reduced cross-sectional flow area further comprises an outwardly tapered surface and a reduced diameter surface extending between the inwardly tapered surface and the outwardly tapered surface so that a velocity of the steam is increased by the inwardly tapered surface and the velocity of the steam is reduced by the outwardly tapered surface.

8. The well assembly of claim 6, wherein the inlet is axially closer to the heel portion than the outlet so that when steam is received by the passageway an axial momentum of the steam is maintained.

9. The well assembly of claim 6, wherein the inwardly tapered surface is tapered about fifteen degrees from an axis of the substantially horizontal section.

10. The well assembly of claim 6, wherein the passageway extends fifteen degrees from the inner surface.

11. The well assembly of claim 6, further comprising:

an annulus formed in the outer surface of the string of tubing that extends around the circumference thereof, the annulus being in fluid communication with the outlet; and a nozzle positioned within the annulus to control the flow of steam received from the outlet.

12. A well assembly for injecting steam into a subterranean reservoir, the well assembly comprising:

a string of tubing in fluid communication with a producing zone of a subterranean reservoir, the string of tubing having a substantially vertical section and a substantially horizontal section extending from a lower portion of the substantially vertical section, the substantially horizontal section defining at one end a heel portion and at an opposite end a toe portion;

a reduced cross-sectional flow area positioned between the heel portion and the toe portion of the substantially horizontal section, the reduced cross-sectional flow area comprising an inwardly tapered surface, an outwardly tapered surface, and a reduced diameter surface extending between the inwardly tapered surface and the outwardly tapered surface;

an opening formed on the inner surface of the reduced cross-sectional flow area that defines an inlet, the inlet being formed at least partially on the inwardly tapered surface; an opening formed on the outer surface of the substantially horizontal section that defines an outlet; and a passageway extending between the inlet and the outlet such that steam received by the inlet is delivered to the outlet;

the inlet being formed in the string of tubing axially closer to the heel portion than the outlet so that when steam is received by the passageway an axial momentum of the steam is maintained for a steam quality difference between the inlet and the outlet ranging from −15 to +15 stem quality units; and wherein the injected steam is a two-phase steam having a steam quality of less than 100% and over 40%,.

13. The well assembly of claim 12, wherein:

the inwardly tapered surface is tapered about fifteen degrees from an axis of the substantially horizontal section.

14. The well assembly of claim 12, further comprising:

an annulus formed in the outer surface of the string of tubing that extends around the circumference thereof, the annulus being in fluid communication with the outlet; and a nozzle positioned within the annulus to control the flow of steam received from the outlet.

* * * * *